US008194861B2

(12) United States Patent
Henn et al.

(10) Patent No.: US 8,194,861 B2
(45) Date of Patent: Jun. 5, 2012

(54) SCHEME FOR GENERATING A PARAMETRIC REPRESENTATION FOR LOW-BIT RATE APPLICATIONS

(75) Inventors: Fredrik Henn, Bromma (SE); Jonas Roeden, Solna (SE)

(73) Assignee: Dolby International AB, Amsterdam Zuid-Oost (NL)

( * ) Notice: Subject to any disclaimer, the term of this patent is extended or adjusted under 35 U.S.C. 154(b) by 1611 days.

(21) Appl. No.: 11/549,939

(22) Filed: Oct. 16, 2006

(65) Prior Publication Data

US 2007/0127733 A1 Jun. 7, 2007

Related U.S. Application Data

(63) Continuation of application No. PCT/EP2005/003950, filed on Apr. 14, 2005.

(30) Foreign Application Priority Data

Apr. 16, 2004 (SE) ..... 0400997

(51) Int. Cl.
*H04R 5/00* (2006.01)

(52) U.S. Cl. ..... 381/22; 381/23; 381/10; 704/501

(58) Field of Classification Search ..... 381/5, 15, 381/17, 18, 19, 20, 21, 22, 23, 307, 310, 381/27, 59, 63, 80, 24, 119, 7, 317, 300; 704/500, 501, 200, 200.1, 203, 94
See application file for complete search history.

(56) References Cited

U.S. PATENT DOCUMENTS

| | | | | |
|---|---|---|---|---|
| 4,251,688 | A * | 2/1981 | Furner | 381/18 |
| 5,890,125 | A | 3/1999 | Davis et al. | |
| 5,909,664 | A * | 6/1999 | Davis et al. | 704/200.1 |
| 6,016,473 | A | 1/2000 | Dolby | |
| 6,904,152 | B1 * | 6/2005 | Moorer | 381/18 |
| 2005/0157883 | A1 * | 7/2005 | Herre et al. | 381/17 |

FOREIGN PATENT DOCUMENTS

| | | |
|---|---|---|
| JP | H05-505298 | 8/1993 |
| WO | 92/12607 | 7/1992 |
| WO | WO 03/007656 A1 | 1/2003 |

OTHER PUBLICATIONS

F. Baumgarte, Binaural Cue Coding—Part 1: Psychoacoustic Fundamentals and Design Principles; IEEE Transactions on Speech and Audio Processing, vol. 11, No. 6 Nov. 2003.
C. Faller, Binaural Cue Coding. Part II: Schemes and Applications, IEEE Transactions on Speech and Audio Processing, 2002.

* cited by examiner

*Primary Examiner* — Vivian Chin
*Assistant Examiner* — Leshui Zhang
(74) *Attorney, Agent, or Firm* — Michael A. Glenn; Glenn Patent Group

(57) ABSTRACT

For generating a parametric representation of a multi-channel signal especially suitable for low-bit rate applications, only the location of the maximum of the sound energy within a replay setup is encoded and transmitted using direction parameter information. For multi-channel reconstruction, the energy distribution of the output channels identified by the direction parameter information is controlled by the direction parameter information, while the energy distribution in the remaining ambience channels is not controlled by the direction parameter information.

10 Claims, 8 Drawing Sheets

| route (3 bits) | PSP | DAP | special case dircet | special case ambience |
|---|---|---|---|---|
| 0 | L & R | Ls & Rs | - | - |
| 1 | R & Rs | L & Ls | - | - |
| 2 | Rs & Ls | R & L | - | - |
| 3 | Ls & L | Rs & R | - | - |
| 4 | L & Rs | R & Ls | - | - |
| 5 | Ls & R | L & Rs | - | - |
| 6 | - | - | L & C & R | Ls & Rs |
| 7 | - | - | all speakers | all speakers |
FIG. 2
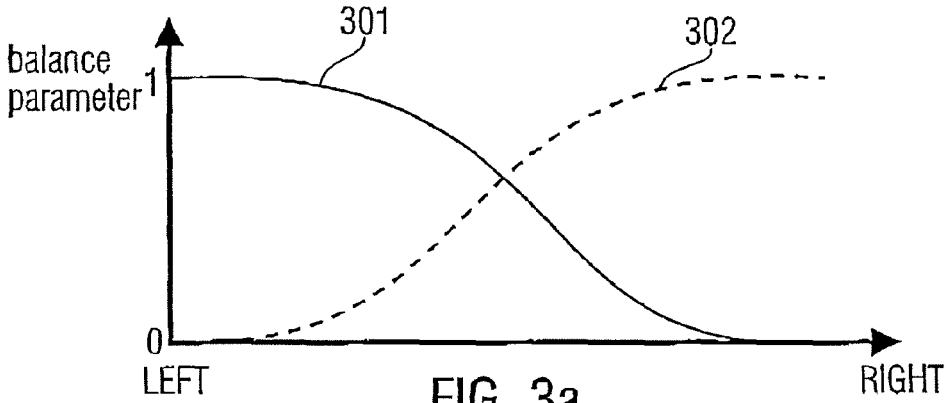
FIG. 3a
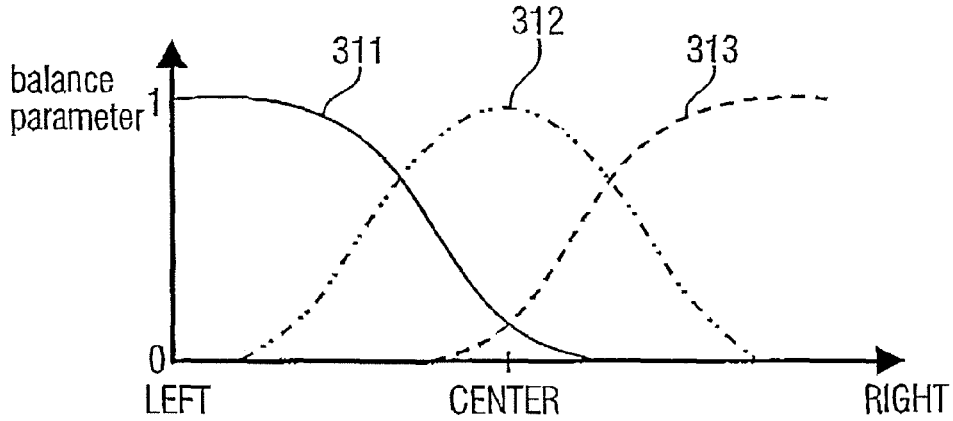
FIG. 3b

SCHEME FOR GENERATING A PARAMETRIC REPRESENTATION FOR LOW-BIT RATE APPLICATIONS

CROSS-REFERENCE TO RELATED APPLICATION

This application is a continuation of co-pending International Application No. PCT/EP2005/003950, filed Apr. 14, 2005, which designated the United States and is incorporated herein by reference in its entirety.

BACKGROUND OF THE INVENTION

1. Field of the Invention

The present invention relates to coding of multi-channel representations of audio signals using spatial parameters. The invention teaches new methods for defining and estimating parameters for recreating a multi-channel signal from a number of channels being less than the number of output channels. In particular it aims at minimizing the bitrate for the multi-channel representation, and providing a coded representation of the multi-channel signal enabling easy encoding and decoding of the data for all possible channel configurations.

2. Description of the Related Art

With a growing interest for multi-channel audio in e.g. broadcasting systems, the demand for a digital low bitrate audio coding technique is obvious. It has been shown in PCT/SE02/01372 "Efficient and scalable Parametric Stereo Coding for Low Bitrate Audio Coding Applications", that it is possible to re-create a stereo image that closely resembles the original stereo image, from a mono downmix signal and an additional very compact parametric representation of the stereo image. The basic principle is to divide the input signal into frequency bands and time segments, and for these frequency bands and time segments, estimate inter-channel intensity difference (IID), and inter-channel coherence (ICC), the first parameter being a measurement of the power distribution between the two channels in the specific frequency band and the second parameter being an estimation of the correlation between the two channels for the specific frequency band. On the decoder side the stereo image is recreated from the mono signal by distributing the mono signal between the two output channels in accordance with the transmitted IID-data, and by adding a decorrelated ambience signal in order to retain the channel correlation properties of the original stereo channels.

Several matrixing techniques exist that create multi-channel output from stereo signals. These techniques often rely on phase differences to create the back channels. Often, the back channels are delayed slightly compared to the front channels. To maximise performance the stereo file is created using special down mixing rules on the encoder side from a multi-channel signal to two stereo base channels. These systems generally have a stable front sound image with some ambience sound in the back channels and there is a limited ability to separate complex sound material into different speakers.

Several multi-channel configurations exist. The most commonly known configuration is the 5.1 configuration (centre channel, front left/right, surround left/right, and the LFE channel). ITU-R BS.775 defines several down-mix schemes for obtaining a channel configuration comprising fewer channels than a given channel configuration. Instead of always having to decode all channels and rely on a down-mix, it can be desirable to have a multi-channel representation that enables a receiver to extract the parameters relevant for the playback channel configuration at hand, prior to decoding the channels. Another alternative is to have parameters that can map to any speaker combination at the decoder side. Furthermore, a parameter set that is inherently scaleable is desirable from a scalable or embedded coding point of view, where it is e.g. possible to store the data corresponding to the surround channels in an enhancement layer in the bitstream.

Another representation of multi-channel signals using a sum signal or down mix signal and additional parametric side information is known in the art as binaural cue coding (BCC). This technique is described in "Binaural Cue Coding—Part 1: Psycho-Acoustic Fundamentals and Design Principles", IEEE Transactions on Speech and Audio Processing, vol. 11, No. 6, November 2003, F. Baumgarte, C. Faller, and "Binaural Cue Coding. Part II: Schemes and Applications", IEEE Transactions on Speech and Audio Processing vol. 11, No. 6, November 2003, C. Faller and F. Baumgarte.

Generally, binaural cue coding is a method for multi-channel spatial rendering based on one down-mixed audio channel and side information. Several parameters to be calculated by a BCC encoder and to be used by a BCC decoder for audio reconstruction or audio rendering include inter-channel level differences, inter-channel time differences, and inter-channel coherence parameters. These inter-channel cues are the determining factor for the perception of a spatial image. These parameters are given for blocks of time samples of the original multi-channel signal and are also given frequency-selective so that each block of multi-channel signal samples have several cues for, several frequency bands. In the general case of C playback channels, the inter-channel level differences and the inter-channel time differences are considered in each subband between pairs of channels, i.e., for each channel relative to a reference channel. One channel is defined as the reference channel for each inter-channel level difference. With the inter-channel level differences and the inter-channel time differences, it is possible to render a source to any direction between one of the loudspeaker pairs of a playback set-up that is used. For determining the width or diffuseness of a rendered source, it is enough to consider one parameter per subband for all audio channels. This parameter is the inter-channel coherence parameter. The width of the rendered source is controlled by modifying the subband signals such that all possible channel pairs have the same inter-channel coherence parameter.

In BCC coding, all inter-channel level differences are determined between the reference channel 1 and any other channel. When, for example, the centre channel is determined to be the reference channel, a first inter-channel level difference between the left channel and the centre channel, a second inter-channel level difference between the right channel and the centre channel, a third inter-channel level difference between the left surround channel and the centre channel, and a forth inter-channel level difference between the right surround channel and the centre channel are calculated. This scenario describes a five-channel scheme. When the five-channel scheme additionally includes a low frequency enhancement channel, which is also known as a "sub-woofer" channel, a fifth inter-channels level difference between the low frequency enhancement channel and the centre channel, which is the single reference channel, is calculated.

When reconstructing the original multi-channel using the single down mix channel, which is also termed as the "mono" channel, and the transmitted cues such as ICLD (Interchannel Level Difference), ICTD (Interchannel Time Difference), and ICC (Interchannel Coherence), the spectral coefficients of the mono signal are modified using these cues. The level modification is performed using a positive real number determining the level modification for each spectral coefficient. The inter-channel time difference is generated using a complex number of magnitude of one determining a phase modification for each spectral coefficient. Another function determines the coherence influence. The factors for level modifications of each channel are computed by firstly calculating the factor for the reference channel. The factor for the reference channel is computed such that for each frequency partition, the sum of the power of all channels is the same as the power of the sum signal. Then, based on the level modification factor for the reference channel, the level modification factors for the other channels are calculated using the respective ICLD parameters.

Thus, in order to perform BCC synthesis, the level modification factor for the reference channel is to be calculated. For this calculation, all ICLD parameters for a frequency band are necessary. Then, based on this level modification for the single channel, the level modification factors for the other channels, i.e., the channels, which are not the reference channel, can be calculated.

This approach is disadvantageous in that, for a perfect reconstruction, one needs each and every inter-channel level difference. This requirement is even more problematic, when an error-prone transmission channel is present. Each error within a transmitted inter-channel level difference will result in an error in the reconstructed multi-channel signal, since each inter-channel level difference is required to calculate each one of the multi-channel output signal. Additionally, no reconstruction is possible, when an inter-channel level difference has been lost during transmission, although this inter-channel level difference was only necessary for e.g. the left surround channel or the right surround channel, which channels are not so important to multi-channel reconstruction, since most of the information is included in the front left channel, which is subsequently called the left channel, the front right channel, which is subsequently called the right channel, or the centre channel. This situation becomes even worse, when the inter-channel level difference of the low frequency enhancement channel has been lost during transmission. In this situation, no or only an erroneous multi-channel reconstruction is possible, although the low frequency enhancement channel is not so decisive for the listeners' listening comfort. Thus, errors in a single inter-channel level difference are propagated to errors within each of the reconstructed output channels.

While such multi-channel parameterization schemes are based on the intention to fully reconstruct the energy distribution, the price one has to pay for this correct reconstruction of the energy distribution is an increased bit rate, since a lot of inter-channel level differences or balance parameters for the spatial energy distribution have to be transmitted. Although these energy distribution schemes naturally do not perform an exact reconstruction of time wave forms of the original channels, they nevertheless result in a sufficient output channel quality because of the exact energy distribution property.

For low-bit rate applications, however, these schemes still require too many bits, which has resulted in the consequence that for such low-bit rate applications, one did not think of a multi-channel reconstruction but one was satisfied with having a mono or stereo reconstruction only.

SUMMARY OF THE INVENTION

It is an object of the present invention to provide a multi-channel processing scheme, which allows a multi-channel reconstruction even under low-bit rate constraints.

In accordance with a first aspect, the present invention provides an apparatus for generating a parametric representation of an original multi-channel signal having at least three original channels, the parameter representation including a direction parameter information to be used in addition to a base channel derived from the at least three original channels for reconstructing an output signal having at least two channels, the original channels being associated with sound sources positioned at different spatial positions in a replay setup, the replay setup having a reference position, having: a direction information calculator for determining the direction parameter information indicating a direction from the reference position to a region in the replay setup, in which a combined sound energy of the at least three original channels is concentrated; and a data output generator for generating the parameter representation so that the parameter representation includes the direction parameter information.

In accordance with a second aspect, the present invention provides an apparatus for reconstructing a multi-channel signal using at least one base channel and a parametric representation including direction parameter information indicating a direction from a reference position in a replay setup to a region in the replay setup, in which a combined sound energy of at least three original channels is concentrated, from which the at least one base channel has been derived, having: an output channel generator for generating a number of output channels to be positioned in the replay setup with respect to the reference position, the number of output channels being higher than the number of base channels, wherein the output channel generator is operative to generate the output channels in response to the direction parameter information so that the direction from the reference position to a region, in which the combined energy of the reconstructed output channels is concentrated depends on the direction indicated by the direction parameter information.

In accordance with a third aspect, the present invention provides a method of generating a parametric representation of an original multi-channel signal having at least three original channels, the parameter representation including a direction parameter information to be used in addition to a base channel derived from the at least three original channels for reconstructing an output signal having at least two channels, the original channels being associated with sound sources positioned at different spatial positions in a replay setup, the replay setup having a reference position, with the steps of: determining the direction parameter information indicating a direction from the reference position to a region in the replay setup, in which a combined sound energy of the at least three original channels is concentrated; and generating the parameter representation so that the parameter representation includes the direction parameter information.

In accordance with a fourth aspect, the present invention provides a method of reconstructing a multi-channel signal using at least one base channel and a parametric representation including direction parameter information indicating a direction from a reference position in a replay setup to a region in the replay setup, in which a combined sound energy of at least three original channels is concentrated, from which the at least one base channel has been derived, with the steps of: generating a number of output channels to be positioned in the replay setup with respect to the reference position, the number of output channels being higher than the number of base channels, wherein the step of generating is performed such that the output channels are generated in response to the direction parameter information so that the direction from the reference position to a region, in which the combined energy of the reconstructed output channels is concentrated depends on the direction indicated by the direction parameter information.

In accordance with a fifth aspect, the present invention provides a computer program having machine-readable instructions for performing, when running on a computer, a method of generating a parametric representation of an original multi-channel signal having at least three original channels, the parameter representation including a direction parameter information to be used in addition to a base channel derived from the at least three original channels for reconstructing an output signal having at least two channels, the original channels being associated with sound sources positioned at different spatial positions in a replay setup, the replay setup having a reference position, with the steps of: determining the direction parameter information indicating a direction from the reference position to a region in the replay setup, in which a combined sound energy of the at least three original channels is concentrated; and generating the parameter representation so that the parameter representation includes the direction parameter information.

In accordance with a sixth aspect, the present invention provides a computer program having machine-readable instructions for performing, when running on a computer, a method of reconstructing a multi-channel signal using at least one base channel and a parametric representation including direction parameter information indicating a direction from a reference position in a replay setup to a region in the replay setup, in which a combined sound energy of at least three original channels is concentrated, from which the at least one base channel has been derived, with the steps of: generating a number of output channels to be positioned in the replay setup with respect to the reference position, the number of output channels being higher than the number of base channels, wherein the step of generating is performed such that the output channels are generated in response to the direction parameter information so that the direction from the reference position to a region, in which the combined energy of the reconstructed output channels is concentrated depends on the direction indicated by the direction parameter information.

In accordance with a seventh aspect, the present invention provides a parameter representation including direction parameter information indicating a direction from a reference position in a replay setup to a region in the replay setup, in which a combined sound energy of at least three original channels is concentrated, from which an at least one base channel has been derived.

The present invention is based on the finding that the main subjective auditory feeling of a listener of a multi-channel representation is generated by her or him recognizing the specific region/direction in a replay setup, in which the sound energy is concentrated. This region/direction can be located by a listener within certain accuracy. Not so important for the subjective listening impression is, however, the distribution of the sound energy between the respective speakers. When, for example, the concentration of the sound energy of all channels is within a sector of the replay setup, which extends between a reference point, which preferably is the center point of a replay setup, and two speakers, it is not so important for the listener's subjective quality impression, how the energy is distributed between the other speakers. When comparing a reconstructed multi-channel signal to an original multi-channel signal, it has been found out that the user is satisfied to a high degree, when the concentration of the sound energy within a certain region in the reconstructed sound field is similar to the corresponding situation of the original multi-channel signal.

In view of this, it becomes clear that prior art parametric multi-channel schemes process and transmit an amount of redundant information, since such schemes have concentrated on encoding and transmitting the complete distribution between all channels in a replay setup.

In accordance with the present invention, only the region including the local sound energy maximum is encoded, while the distribution of energy between other channels, which do not have main contributions to this local maximum sound energy, is neglected and, therefore, does not involve any bits for transmitting this information. Thus, the present invention encodes and transmits even less information from a sound field compared to prior art full-energy distribution systems and, therefore, also allows a multi-channel reconstruction even under very restrictive bit rate conditions.

Stated in other words, the present invention determines the direction of the local sound maximum region with respect to a reference position and, based on this information, a subgroup of speakers such as the speakers defining a sector, in which the sound maximum is positioned or two speakers surrounding the sound-maximum, is selected on the decoder-side. This selection only uses transmitted direction information for the maximum energy region. On the decoder-side, the energy of the signals in the selected channels is set such that the local sound maximum region is reconstructed. The energies in the selected channels can—and will necessarily be—different from the energies of the corresponding channels in the original multi-channel signal. Nevertheless, the direction of the local sound maximum is identical to the direction of the local maximum in the original signal or is at least quite similar. The signals for the remaining channels will be created synthetically as ambience signals. The ambience signals are also derived from the transmitted base channel(s), which typically will be a mono channel. For generating the ambience channels, however, the present invention does not necessarily need any transmitted information. Instead, decorrelated signals for the ambience channels are derived from the mono signals such as by using a reverberator or any other known device for generating decorrelated signal.

For making sure that the combined energy of the selected channels and the remaining channels is similar to the mono signal or the original signal, a level control is performed, which scales all signals in the selected channels and the remaining channels such that the energy condition is fulfilled. This scaling of all channels, however, does not result in a moving of the energy maximum region, since this energy maximum region is determined by a transmitted direction information, which is used for selecting the channels and for adjusting the energy ratio between the energies in the selected channels.

Subsequently, two preferred embodiments are summarized. The present invention relates to the problem of a parameterized multi-channel representation of audio signals. One preferred embodiment includes a method for encoding and decoding sound positioning within a multi-channel audio signal, comprising: down-mixing the multi-channel signal on the encoder side, given said multi-channel signal; selecting a channel pair within the multi-channel signal; at the encoder, calculating parameters for positioning a sound between said selected channels; encoding said positioning parameters and said channel pair selection; at the decoder side, recreating multi-channel audio according to said selection and positioning parameters decoded from bitstream data.

A further embodiment includes a method for encoding and decoding sound positioning within a multi-channel audio signal, comprising: down-mixing the multi-channel signal on the encoder side, given said multi-channel signal; calculating an angle and a radius that represent said multi-channel signal; encoding said angle and said radius; at the decoder side, recreating multi-channel audio according to said angle and said radius decoded from the bitstream data.

BRIEF DESCRIPTION OF THE DRAWINGS

The present invention will now be described by way of illustrative examples, not limiting the scope or spirit of the invention, with reference to the accompanying drawings, in which:

FIG. 2 illustrates a possible signalling table for a route & pan parameter system;

FIG. 3*a* illustrates a possible two channel panning;

FIG. 3*b* illustrates a possible three channel panning;

DESCRIPTION OF THE PREFERRED EMBODIMENTS

The below-described embodiments are merely illustrative for the principles of the present invention on multi-channels representation of audio signals. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

A first embodiment of the present invention, hereinafter referred to as 'route & pan', uses the following parameters to position an audio source across the speaker array:

- a panorama parameter for continuously positioning the sound between two (or three) loudspeakers; and
- routing information defining the speaker pair (or triple) the panorama parameter applies to.

Figure 1A:
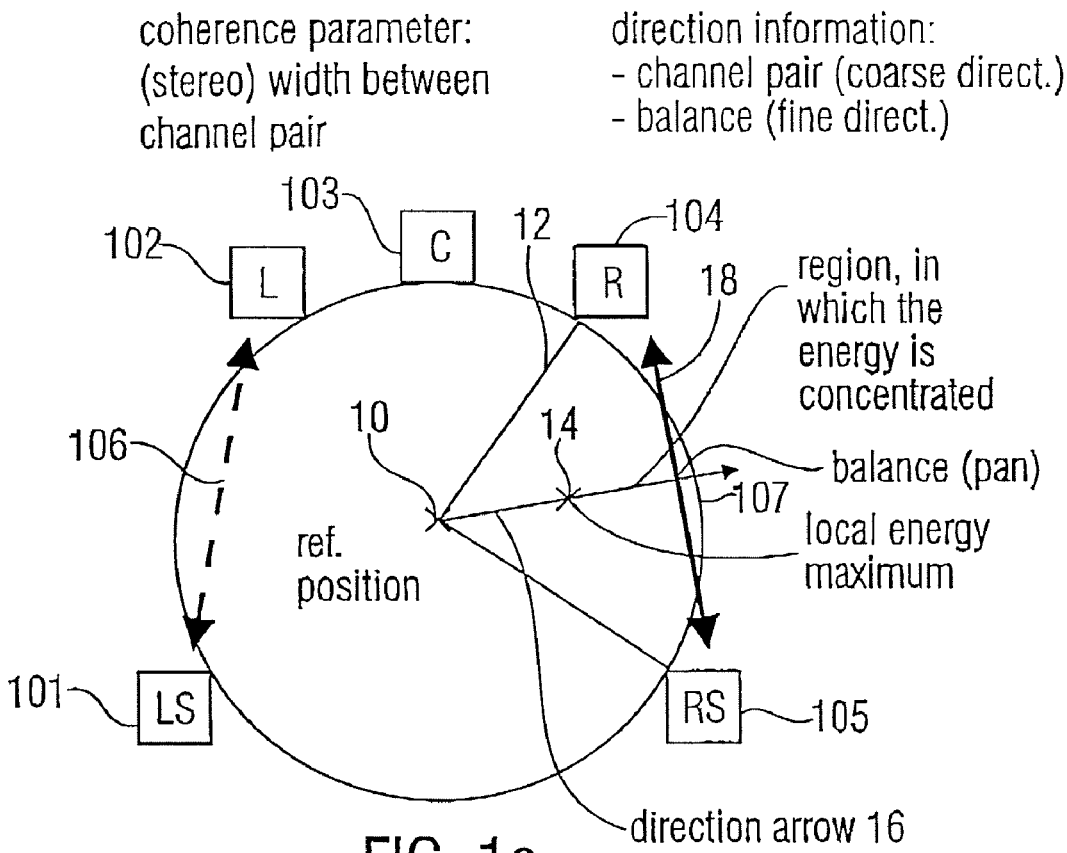
FIG. 1*a* illustrates a possible signalling for a route & pan parameter system.
Figure 1B:
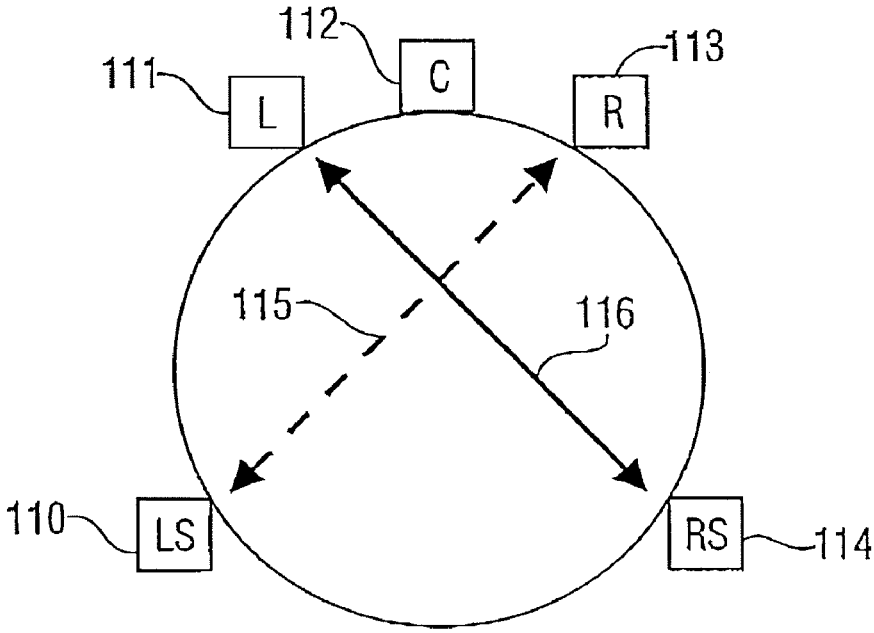
FIG. 1*b* illustrates a possible signalling for a route & pan parameter system.
Figure 1C:
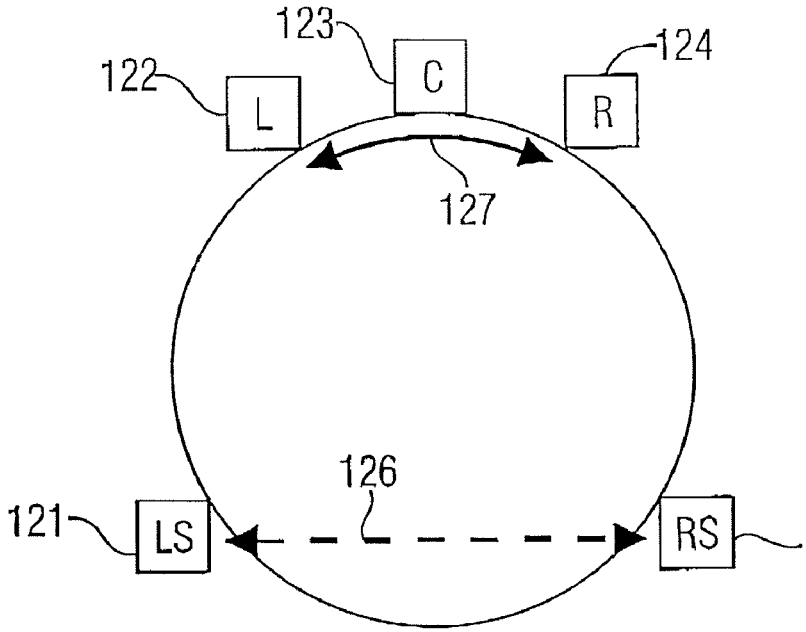
FIG. 1*c* illustrates a possible signalling for a route & pan parameter system.

FIGS. 1*a* through 1*c* illustrate this scheme, using a typical five loudspeaker setup comprising of a left front channel speaker (L), 102, 111 and 122, a centre channel speaker (C), 103, 112 and 123, a right front channel speaker (R), 104, 113 and 124, a left surround channel speaker (Ls) 101, 110 and 121 and a right surround channel speaker (Rs) 105, 114 and 125. The original 5 channel input signal is downmixed at an encoder to a mono signal which is coded, transmitted or stored.

In the example in FIG. 1*a*, the encoder has determined that the sound energy basically is concentrated to 104 (R) and 105 (Rs). Thus, the channels 104 and 105 have been selected as the speaker pair which the panorama parameter is applied to. The panorama parameter is estimated, coded and transmitted in accordance with prior art methods. This is illustrated by the arrow 107, which defines the limits for positioning a virtual sound source at this particular speaker pair selection. Similarly, an optional stereo width parameter can be derived and signalled for said channel pair in accordance with prior art methods. The channel selection can be signalled by means of a three bit 'route' signal, as defined by the table in FIG. 2. PSP denotes Parametric Stereo Pair, and the second column of the table lists which speakers to apply the panning and optional stereo width information at a given value of the route signal. DAP denotes Derived Ambience Pair, i.e. a stereo signal which is obtained by processing the PSP with arbitrary prior art methods for generating ambience signals. The third column of the table defines which speaker pair to feed with the DAP signal, the relative level of which is either predefined or optionally signalled from the encoder by means of an ambience level signal. Route values of 0 through 3 correspond to turning around a 4 channel system (disregarding the centre channel speaker (C) for now), comprising of a PSP for the "front" channels and DAP for the "back" channels in 90 degree steps (approximately, depending on the speaker array geometry). Thus FIG. 1*a* corresponds to route value 1, and 106 defines the spatial coverage of the DAP signal. Clearly this method allows for moving sound objects 360 degrees around the room by selecting speaker pairs corresponding to route values 0 through 3.

Figure 1D:
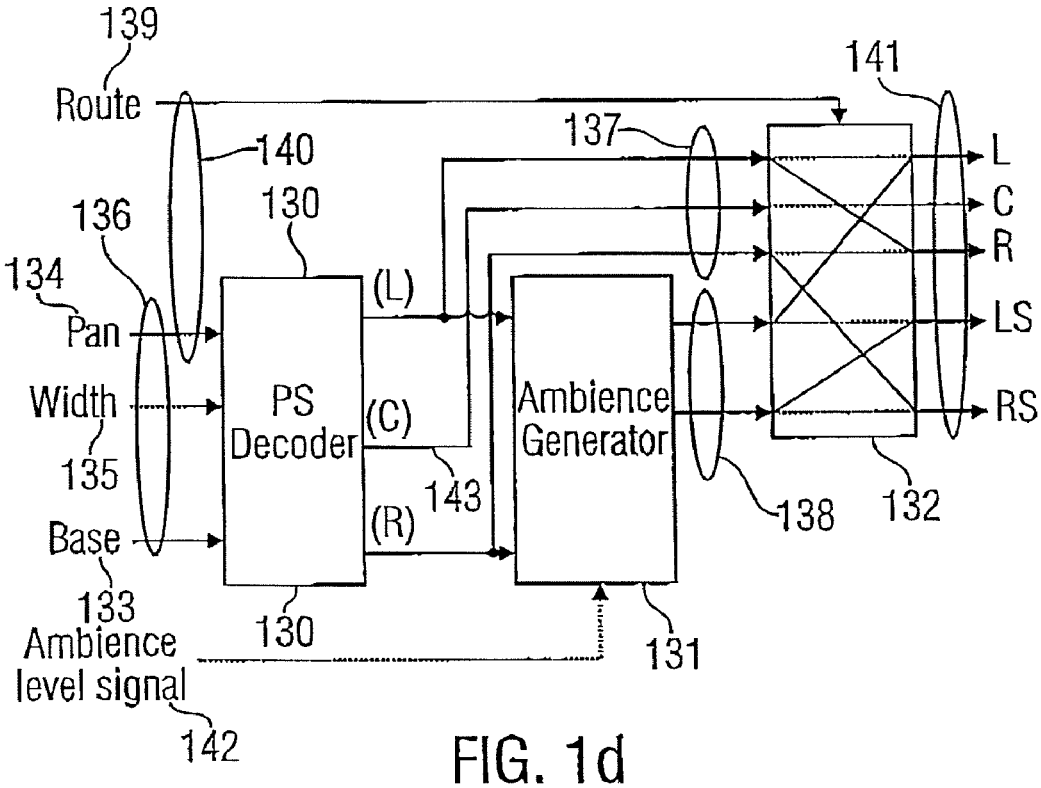
FIG. 1*d* illustrates a possible block diagram for a route & pan parameter system decoder.

FIG. 1*d* is a block diagram of one possible embodiment of a route and pan decoder comprising of a parametric stereo decoder according to prior art 130, an ambience signal generator 131, and a channel selector 132. The parametric stereo decoder takes a base channel (downmix) signal 133, a panorama signal 134, and a stereo width signal 135 (corresponding to a parametric stereo bitstream according to prior art methods, 136) as input, and generates a PSP signal 137, which is fed to the channel selector. In addition, the PSP is fed to the ambience generator, which generates a DAP signal 138 in accordance with prior art methods, e.g. by means of delays and reverberators, which also is fed to the channel selector. The channel selector takes a route signal 139, (which together the panorama signal forms the direction parameter information 140) and connects the PSP and DAP signals to the corresponding output channels 141, in accordance with the table in FIG. 2. The straight lines within the channel selector correspond to the case illustrated by FIG. 1*a* and FIG. 2, route=1. Optionally, the ambience generator takes an ambience level signal as input, 142 to control the level the ambience generator output. In an alternative embodiment the ambience generator 131 would also utilize the signals 134 and 135 for the DAP generation.

FIG. 1*b* illustrates another possibility of this scheme: Here the non-adjacent 111 (L) and 114 (Rs) are selected as the speaker pair. Hence, a virtual sound source can be moved diagonally by means of the pan parameter, as illustrated by the arrow 116. 115 outlines the localization of the corresponding DAP signal. Route values 4 and 5 in FIG. 2 correspond to this diagonal panning.

In a variation of the above embodiment, when selecting two non-adjacent speakers, the speaker(s) between the selected speaker-pair is fed according to a three-way panning scheme, as illustrated by FIG. 3*b*. For reference FIG. 3*a* shows a conventional stereo panning scheme, and FIG. 3*b* a three-way panning scheme, both according to prior art methods. FIG. 1*c* gives an example of application of a three-way panning scheme: E.g. if 102 (L) and 104 (R) form the speaker pair, the signal is routed to 103 (C) for mid-position pan values. This case is further illustrated by the dashed lines in the channel selector 132 of FIG. 1*d*, where the center channel output 143 of the generalized parametric stereo decoder is active due to the 3 way panning employed. In order to stabilize the sound stage, pan-curves with large overlap may be used: The outer speaker then contribute to the reproduction also at mid-position panning, wherein the signal from the middle speaker is attenuated correspondingly, such that a constant power is achieved across the entire panning range. Further examples of routing where three-way panning can be used are C-R-Rs and L-[Ls & R]-Rs (i.e. mid-position panning yields signals from both Ls and R). Whether the three-way-panning should be applied or not can, of course, be signalled by the route signal. Alternatively, a predefined behaviour could be that the three-way-panning should be applied if two non-adjacent speakers having at least one speaker in between are indexed with the route signal.

The above scheme copes well with single sound sources, and is useful for special sound effects, e.g. a helicopter flying around. Multiple sources at different positions but separated in frequency are also covered, if individual routing and panning for different frequency bands is employed.

A second embodiment of the present invention, hereinafter referred to as 'angle & radius', is a generalization of the above scheme wherein the following parameters are used for positioning:

an angle parameter for continuously positioning a sound across the entire speaker array (360 degree range); and a radius parameter for controlling the spread of sound across the speaker array (0-1 range).

In other words, multiple speaker music material can be represented by polar-coordinates, an angle $\alpha$ and a radius r, where a can cover the full 360 degrees and hence the sound can be mapped to any direction. The radius r enables that sound can be mapped to several speakers and not only to two adjacent speakers. It can be viewed as a generalisation of the above three-way panning, where the amount of overlap is determined by the radius parameter (e.g. a large value of r corresponds to a small overlap).

To exemplify the embodiment above, a radius in the range of [r], which is defined from 0 to 1, is assumed. 0 means that all speakers have the same amount of energy, and 1 could be interpreted as that two channel panning should be applied between the two adjacent speakers that are closest to the direction defined by [$\alpha$]. At the encoder, [$\alpha$, r] can be extracted using e.g. the input speaker configuration and the energy in each speaker to calculate a sound centre point in analogy to the centre of mass. Generally, the sound centre point will be closer to a speaker emitting more sound energy than a different speaker in a replay setup. For calculating the sound centre point, one can use the spatial positions of the speakers in a replay setup, optionally a direction characteristic of the speakers, and the sound energy emitted by each speaker, which directly depends on the energy of the electrical signal for the respective channel.

The sound centre point which is located within the multi channel speaker setup is then parameterized with an angle and a radius [$\alpha$, r].

At the decoder side multiple speaker panning rules are utilized for the currently used speaker configuration to give all [$\alpha$,r] combinations a defined amount of sound in each speaker. Thus, the same sound source direction is generated at the decoder side as was present at the encoder side.

Another advantage with the current invention is that the encoder and decoder channel configurations do not have to be identical, since the parameterization can be mapped to the speaker configuration currently available at the decoder in order to still achieve the correct sound localization.

Figure 4A:
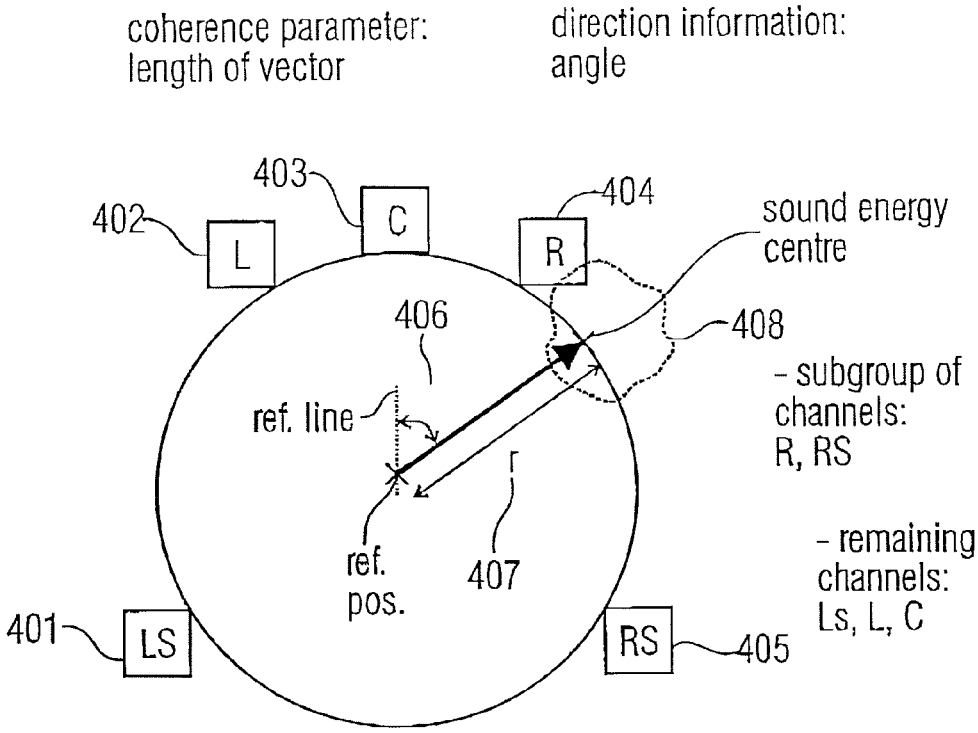
FIG. 4*a* illustrates a possible signalling for an angle and radius parameter system.

FIG. 4*a*, where 401 through 405 correspond to 101 through 105 in FIG. 1*a*, exemplifies a case where the sound 408 is located close to the right front speaker (R) 404. Since r 407 is 1 and $\alpha$ 406 points between the right front speaker (R) 404 and the right surround speaker (RS) 405. The decoder will apply two channels panning between the right front speaker (R) 404 and the right surround speaker (RS).

Figure 4B:
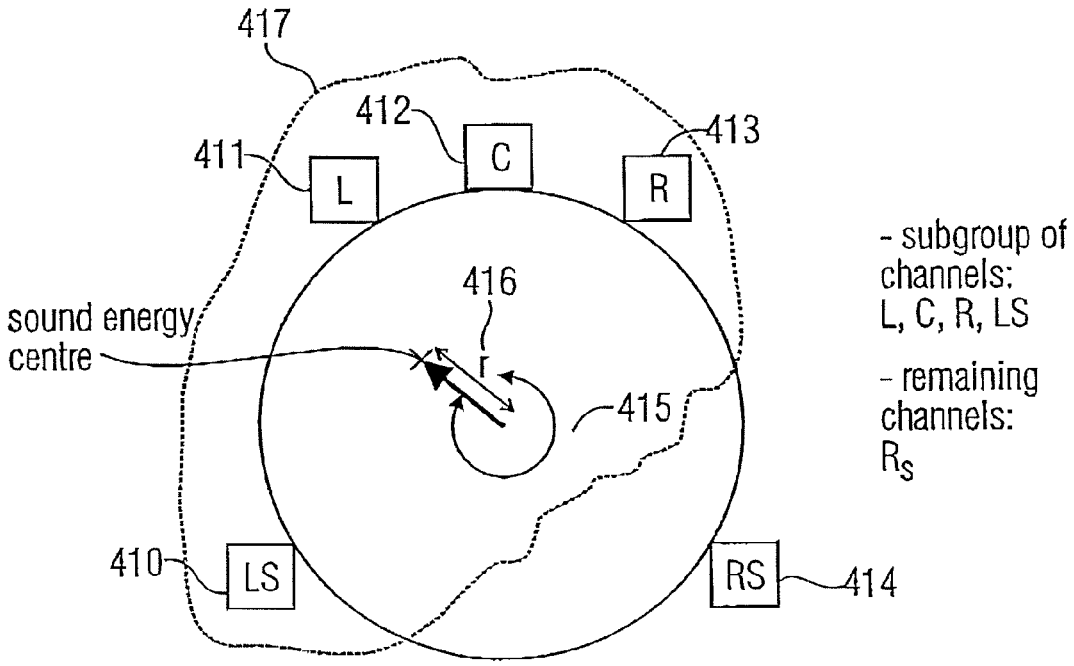
FIG. 4*b* illustrates a possible signalling for an angle and radius parameter system.

FIG. 4*b*, where 410 through 414 correspond to 101 through 105 in FIG. 1*a*, exemplifies a case where the sound image 417 general direction is close to the left front speaker 411. The extracted $\alpha$ 415 will point towards the middle of the sound image and the extracted r 416 ensures that the decoder can recreate the sound image width using multi speaker panning to distribute the transmitted audio signal belonging to the extracted $\alpha$ 415 and r 416.

The angle & radius parameterisation can be combined with pre-defined rules where an ambience signal is generated and added to the opposite direction (of $\alpha$). Alternatively a separate signalling of angle and radius for an ambience signal can be employed.

In preferred embodiments, some additional signalling is used to adapt the inventive scheme to certain scenarios. The above two basic direction parameter schemes do not cover all scenarios well. Often, a "full soundstage" is needed across L-C-R, and in addition a directed sound is desired from one back channel. There are several possibilities to extend the functionality to cope with this situation:

1. Send additional parameter-sets on an as-needed basis. E.g. a system defaults to a 1:1 relation between the downmix signal and the parameters, but occasionally a second parameter-set is sent which also operates on the downmix signal corresponding to a 1:2 configuration. Clearly, arbitrary additional sources are obtainable in this fashion by means of superimposing the decoded parameters.
2. Use decoder side rules (depending on routing and panning or angle and radius values) to override the default panning behaviour. One possible rule, assuming separate parameters for individual frequency bands, is "When only a few frequency bands are routed and panned substantially different than the others, interpolate panning of 'the others' for the 'few bands' and apply the signalled panning for 'the few ones' in addition to achieve the same effect as in example 1. A flag could be used to switch this behaviour on/off.

Stated in other words, this example uses separate parameters for individual frequency bands, and is employing interpolation in the frequency direction according to the following: If only a few frequency bands are routed and panned substantially different (out-layers) than the others (main group), the parameters of the out-layers are to be interpreted as additional parameter sets according to the above (although not transmitted). For said few frequency bands, the parameters of the main group are interpolated in the frequency direction. Finally the two sets of parameters now available for the few bands are superimposed. This allows placing an additional source at a substantially different direction than that of the main group, without sending additional parameters, while avoiding a spectral hole in the main direction for the few out-layer bands. A flag could be used to switch this behaviour on/off.
3. Signal some special preset mappings, e.g.

a) Route signal to all speakers;

b) Route signal to arbitrary single speaker; and c) Route signal to selected subsets of speakers (>2).

The above three extended cases apply to the route & pan scheme as well as to the angle & radius scheme. Preset mappings are particularly useful for the route & pan case as evident from the below example, where also ambience signals are discussed.

FIG. 2 finally gives an example of possible special preset mappings: The last two route values, 6 and 7, correspond to special cases where no panning info is transmitted, and the downmix signal is mapped according to the $4^{th}$ column, and ambience signals are generated and mapped according to the last column. The case defined by the last row creates an "in the middle of a diffuse sound field" impression. A bitstream for a system according to this example could in addition include a flag for enabling three-way panning whenever speaker pairs in the PSP column are not adjacent within the speaker array.

A further example of the present invention is a system using one angle and radius parameter-set for the direct sound, and a second angle and radius parameter-set for the ambience sound. In this example a mono signal is transmitted and used both for the angle and radius parameter-set panning the direct sound and the creation of a decorrelated ambience signal which is then applied using the angle and radius parameter-set for the ambience. Schematically a bitstream example could look like:

<angle_direct,radius_direct>
<angle_ambience,radius_ambience>
<M>

A further example of the present invention utilizes both route & pan and angle & radius parameterisations and two mono signals. In this example the angle & radius parameters describe the panning of the direct sound from the mono signal M1. Furthermore route & pan is used to describe how the ambience signal generated from M2 is applied. Hence the transmitted route value describes, in which channels the ambience signal should be applied and as an example the ambience representation of FIG. 2 could be utilized. The corresponding bitstream example could look like:

<angle_direct,radius_direct>
<route,ambience_level>
<M1_direct>
<M2_ambience>

The parameterisation schemes for spatial positioning of sounds in a multichannel speaker setup according to the present invention are building blocks that can be applied in a multitude of ways:

i) Frequency range:
  Global (for all frequency bands) routing; or
  Per-band routing.
ii) Number of parameter sets:
  Static (fixed over time); or
  Dynamic (additional sets sent on as-needed basis).
iii) Signal application, i.e. coding of:
  Direct (dry) sound; or
  Ambient (wet) sound.
iv) Relations between the number of downmix signals and parameter sets, e.g.:
  1:1 (mono downmix and single parameter set);
  2:1 (stereo downmix and single parameter set); or
  1:2 (mono downmix and two parameter sets). The downmix signal M is assumed to be the sum of all original input channels. It can be an adaptively weighted and adaptively phase adjusted sum(s) of all inputs.
v) Super position of downmix signals and parameter sets, e.g.
  1:1+1:1 (two different mono downmixes and corresponding single parameter sets)

The latter is useful for adaptive downmix & coding, e.g. array (beamforming) algorithms, signal separation (encoding of primary max, secondary max, . . . ).

For the sake of clarity, in the following, panning using a balance parameter between two channels (FIG. 3*a*) or between three channels (FIG. 3*b*) according to prior art is described. Generally, the balance parameter indicates the localization of a sound source between two different spatial positions of, for example two speakers in a replay setup. FIG. 3*a* and FIG. 3*b* indicate such a situation between the left and the right channel.

FIG. 3*a* illustrates an example of how a panorama parameter relates to the energy distribution across the speaker pair. The x-axis is the panorama parameter, spanning the interval [−1,1], which corresponds to [extreme left, extreme right]. The y-axis spans [0,1] where 0 corresponds to 0 output and 1 to full relative output level. Curve 301 illustrates how much output is distributed to the left channel dependant on the panning parameter and 302 illustrates the corresponding output for the right channel. Hence a parameter value of −1 yield that all input should be panned to the left speaker and zero to the right speaker, consequently vice versa is true for a panning value of 1.

FIG. 3*b* indicates a three-way panning situation, which shows three possible curves 311, 312 and 313. Similarly as in FIG. 3*a* the x-axis cover [−1,1] and the y-axis spans [0,1]. As before curve 311 and 312 illustrates how much signal is distributed to left and right channels. Curve 312 illustrates how much signal is distributed to the centre channel.

Figure 5A:
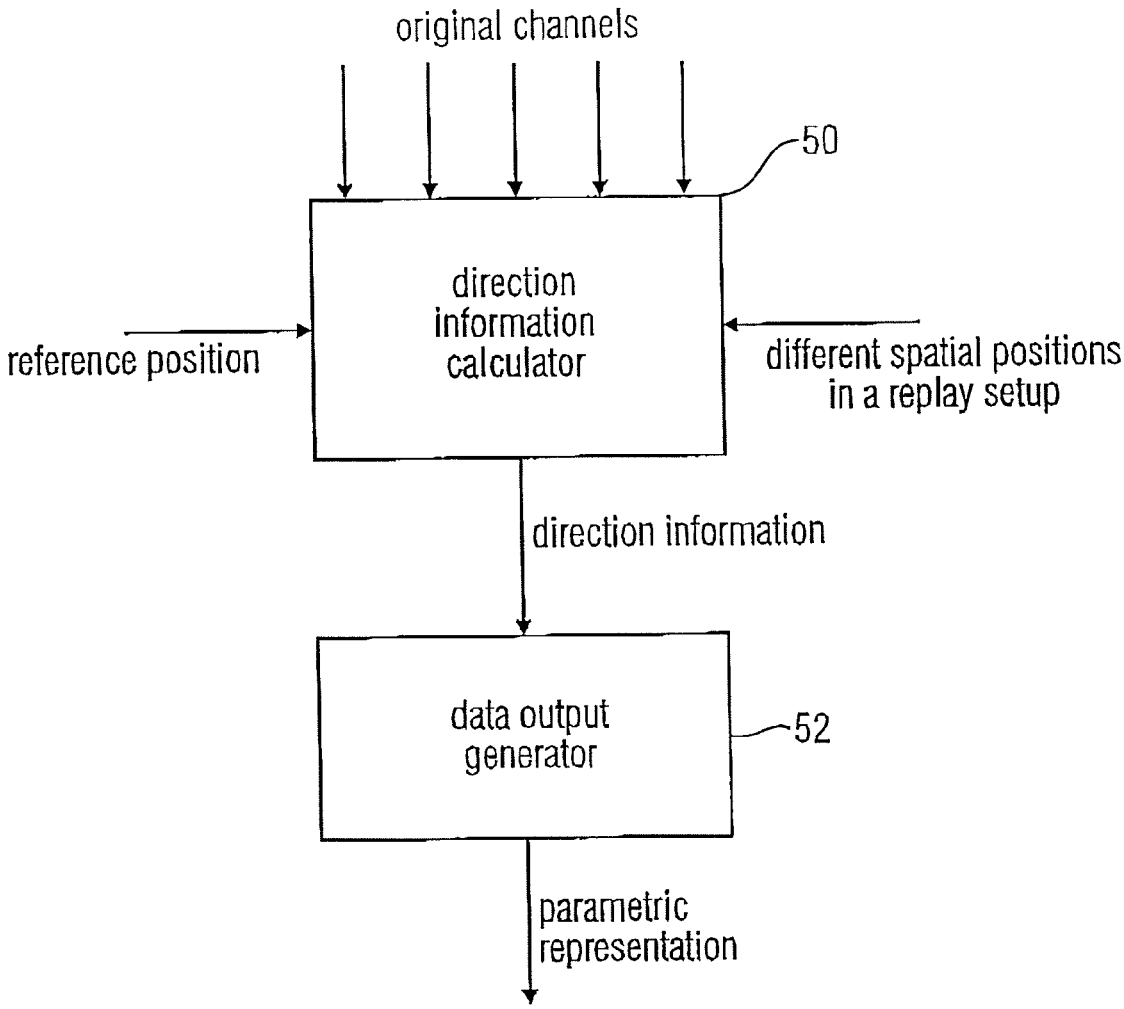
FIG. 5*a* illustrates a block diagram of an inventive apparatus for generating a parametric representation of an original multi-channel signal.

Subsequently, the inventive concept will be discussed in connection with FIGS. 5*a* to 6*b*. FIG. 5*a* illustrates an inventive apparatus for generating a parametric representation of an original multi-channel signal having at least three original channels, the parametric representation including a direction parameter information to be used in addition to a base channel derived from the at least three original channels for reconstructing an output signal having at least two channels. Furthermore, the original channels are associated with sound sources positioned at different spatial positions in a replay setup as has been discussed in connection with FIGS. 1*a*, 1*b*, 1*c*, 4*a*, 4*b*. Each replay setup has a reference position 10 (FIG. 1*a*), which is preferably a center of a circle, along which the speakers 101 to 105 are positioned.

The inventive apparatus includes a direction information calculator 50 for determining the direction parameter information. In accordance with the present invention, the direction parameter information indicate a direction from the reference position 10 to a region in a replay setup, in which a combined sound energy of the at least three original channels is concentrated. This region is indicated as a sector 12 in FIG. 1*a*, which is defined by lines extending from the reference position 10 to the right channel 104 and extending from the reference position 10 to the right surround channel 105. It is assumed that, in the present audio scene, there is, for example, a dominant sound source positioned in the region 12. Additionally, it is assumed that the local sound energy maximum between all five channels or at least the right and the right surround channels is at a position 14. Additionally, a direction from the reference position to the region and, in particular, to the local energy maximum 14 is indicated by a direction arrow 16. The direction arrow is defined by the reference position 10 and the local energy maximum position 14.

In accordance with the first embodiment, which has, as the direction parameter information, the route information indicating a channel pair, and the balance or pan parameter indicating an energy distribution between the two selected channels, the reconstructed energy maximum can only be shifted along the double-headed arrow 18. The degree or position, where the local energy maximum in a multi-channel reconstruction can be placed along the arrow 18 is determined by the pan or balance parameter. When, for example, the local sound maximum is at 14 in FIG. 1*a*, this point can not exactly be encoded in this embodiment. For encoding the local energy maximum direction, however, a balance parameter indicating this direction would be a parameter, which results in a reconstructed local energy maximum lying on the crossing point between arrow 18 and arrow 16, which is indicated as "balance (pan)" in FIG. 1*a*.

One possible embodiment of a route & pan scheme encoder is to first calculate the local energy maximum, 14 in FIG. 1*a*, and the corresponding angle and radius. Using the angle, a channel pair (or triple) selected, which yields a route parameter value. Finally the angle is converted to a pan value for the selected channel pair, and, optionally the radius is used to calculate an ambience level parameter.

The FIG. 1*a* embodiment is advantageous, however, in that it is not necessary to exactly calculate the local energy maximum 14 for determining the channel pair and the balance. Instead, necessary direction information is simply derived from the channels by checking the energies in the original channels and by selecting the two channels (or channel triple e.g. L-C-R) having the highest energies. This identified channel pair (triple) defines a sector 12 in the replay setup, in which the local energy maximum 14 will be positioned. Thus, the channel pair selection is already a determination of a coarse direction. The "fine tuning" of the direction will be performed by the balance parameter. For a rough approximation, the present invention determines the balance parameter simply by calculating the quotient between the energies in the selected channels. Thus, because of the other channels C, L, Ls, which have not been selected, the direction 16 encoded by channel pair selection and balance parameter may deviate a little bit from the actual local energy maximum direction because of the contributions of the other speakers. For the sake of bit rate reduction, however, such deviations are accepted in the FIG. 1*a* route and pan embodiment.

The FIG. 5*a* apparatus additionally includes a data output generator 52 for generating the parametric representation so that the parametric representation includes the direction parameter information. It is to be noted that, in a preferred embodiment, the direction parameter information indicating a (at least) rough direction from the reference position to the local energy maximum is the only inter-channel level difference information transmitted from the encoder to the decoder. In contrast to the prior art BCC scheme, the present invention, therefore, only has to transmit a single balance parameter rather than 4 or 5 balance parameters for a five channel system.

Preferably, the direction information calculator 50 is operative to determine the direction information such that the region, in which the combined energy is concentrated, includes at least 50% of the total sound energy in the replay setup.

Furthermore or alternatively, it is preferred that the direction information calculator 50 is operative to determine the direction information such that the region only includes positions in the replay setup having a local energy value which is greater than 75% of a maximum local energy value, which is also positioned within the region.

Figure 5B:
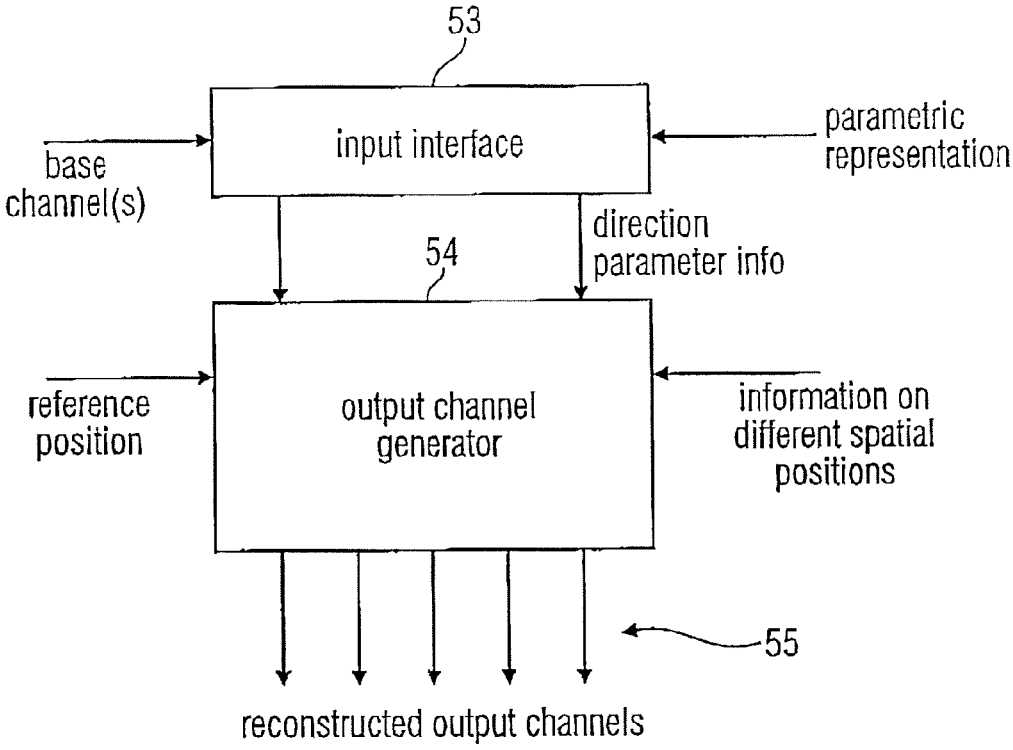
FIG. 5*b* indicates a schematic block diagram of an inventive apparatus for reconstructing a multi-channel signal.

FIG. 5*b* indicates an inventive decoder setup. In particular, FIG. 5*b* shows an apparatus for reconstructing a multi-channel signal using at least one base channel and a parametric representation including direction parameter information indicating a direction from a position in the replay setup to the region in the replay setup, in which a combined sound energy of at least three original channels is concentrated, from which the at least one base channel has been derived. In particular, the inventive device includes an input interface 53 for receiving the at least one base channel and the parametric representation, which can come in a single data stream or which can come in different data streams. The input interface outputs the base channel and the direction parameter information into an output channel generator 54.

The output channel generator is operative for generating a number of output channels to be positioned in the replay setup with respect to the reference position, the number of output channels being higher than a number of base channels. Inventively, the output channel generator is operative to generate the output channels in response to the direction parameter information so that a direction from the reference point to a region, in which the combined energy of the reconstructed output channels is concentrated, is similar to the direction indicated by the direction parameter information. To this end, the output channel generator 54 needs information on the reference position, which can be transmitted or, preferably, predetermined. Additionally, the output channel generator 54 requires information on different spatial positions of speakers in the replay setup which are to be connected to the output channel generator at the reconstructed output channels output 55. This information is also preferably predetermined and can be signaled easily by certain information bits indicating a normal five plus one setup or a modified setup or a channel configuration having seven or more or less channels.

Figure 5C:
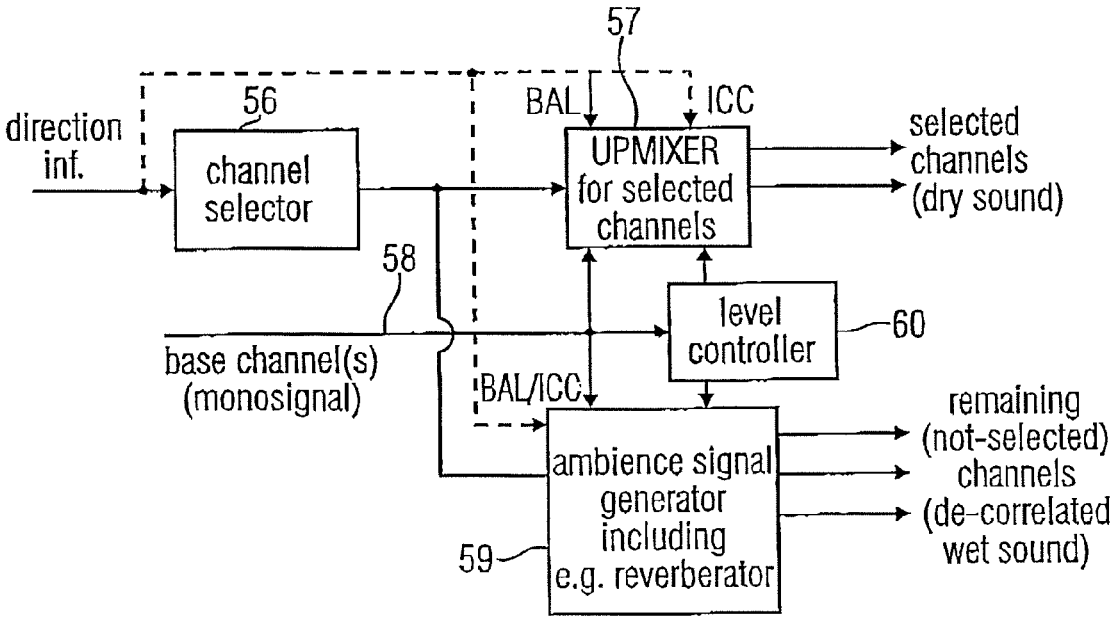
FIG. 5*c* illustrates a preferred embodiment of the output channel generator of FIG. 5*b;*

The preferred embodiment of the inventive output channel generator 54 in FIG. 5*b* is indicated in FIG. 5*c*. The direction information is input into a channel selector. The channel selector 56 selects the output channels, whose energy is to be determined by the direction information. In the FIG. 1 embodiment, the selected channels are the channels of the channel pair, which are signaled more or less explicitly in the direction information route bits (first column of FIG. 2).

In the FIG. 4 embodiment, the channels to be selected by the channel selector 56 are signaled implicitly and are not necessarily related to the replay setup connected to the reconstructor. Instead, the angle $\alpha$ is directed to a certain direction in the replay setup. Irrespective of the fact, whether the replay speaker setup is identical to the original channel setup, the channel selector 56 can determine the speakers defining the sector, in which the angle $\alpha$ is positioned. This can be done by geometrical calculations or preferably by a look-up table.

Additionally, the angle is also indicative of the energy distribution between the channels, defining the sector. The particular angle $\alpha$ further defines a panning or a balancing of the channel. When FIG. 4*a* is considered, the angle $\alpha$ crosses the circle at a point, which is indicated as, "sound energy center", which is more close to the right speaker 404 than to the right surround speaker 405. Thus, a decoder calculates a balance parameter between speaker 404 and speaker 405 based on the sound energy center point and the distances of this point to the right speaker 404 and the right surround speaker 405. Then, the channel selector 56 signals its channel selection to the up-mixer. The channel selector will select at least two channels from all output channels and, in the FIG. 4*b* embodiment, even more than two speakers. Nevertheless, the channel selector will never select all speakers except a case, in which a special all speaker information is signaled. Then, an up-mixer 57 performs an up-mix of the mono signal received via the base channel line 58 based on a balance parameter explicitly transmitted into the direction information or based on the balance value derived from the transmitted angle. In a preferred embodiment, also an inter-channel coherence parameter is transmitted and used by the up-mixer 57 to calculate the selected channels. The selected channels will output the direct or "dry sound", which is responsible for reconstructing the local sound maximum, wherein the position of this local sound maximum is encoded by the transmitted direction information.

Preferably, the other channels, i.e., the remaining or non-selected channels are also provided with output signals. The output signals for the other channels are generated using an ambience signal generator, which, for example, includes a reverberator for generating a decorrelated "wet" sound. Preferably, the decorrelated sound is also derived from the base channel(s) and is input into the remaining channels. Preferably, the inventive output channel generator 54 in FIG. 5*b* also includes a level controller 60, which scales the up-mixed selected channels as well as the remaining channels such that the overall energy in the output channels is equal or in a certain relation to the energy in the transmitted base channel(s). Naturally, the level control can perform a global energy scaling for all channels, but will not substantially alter the sound energy concentration as encoded and transmitted by the direction parameter information.

In a low-bit rate embodiment, the present invention does not require any transmitted information for generating the remaining ambience channels, as has been discussed above. Instead, the signal for the ambience channels is derived from the transmitted mono signal in accordance with a predefined decorrelation rule and is forwarded to the remaining channels. The level difference between the level of the ambience channels and the level of the selected channels is predefined in this low-bit rate embodiment.

For more advanced devices, which provide a better output quality, but which also require an increased bit rate, an ambience sound energy direction can also be calculated on the encoder side and transmitted. Additionally, a second down-mix channel can be generated, which is the "master channel" for the ambience sound. Preferably, this ambience master channel is generated on the encoder side by separating ambience sound in the original multi-channel signal from non-ambience sound.

Figure 6A:
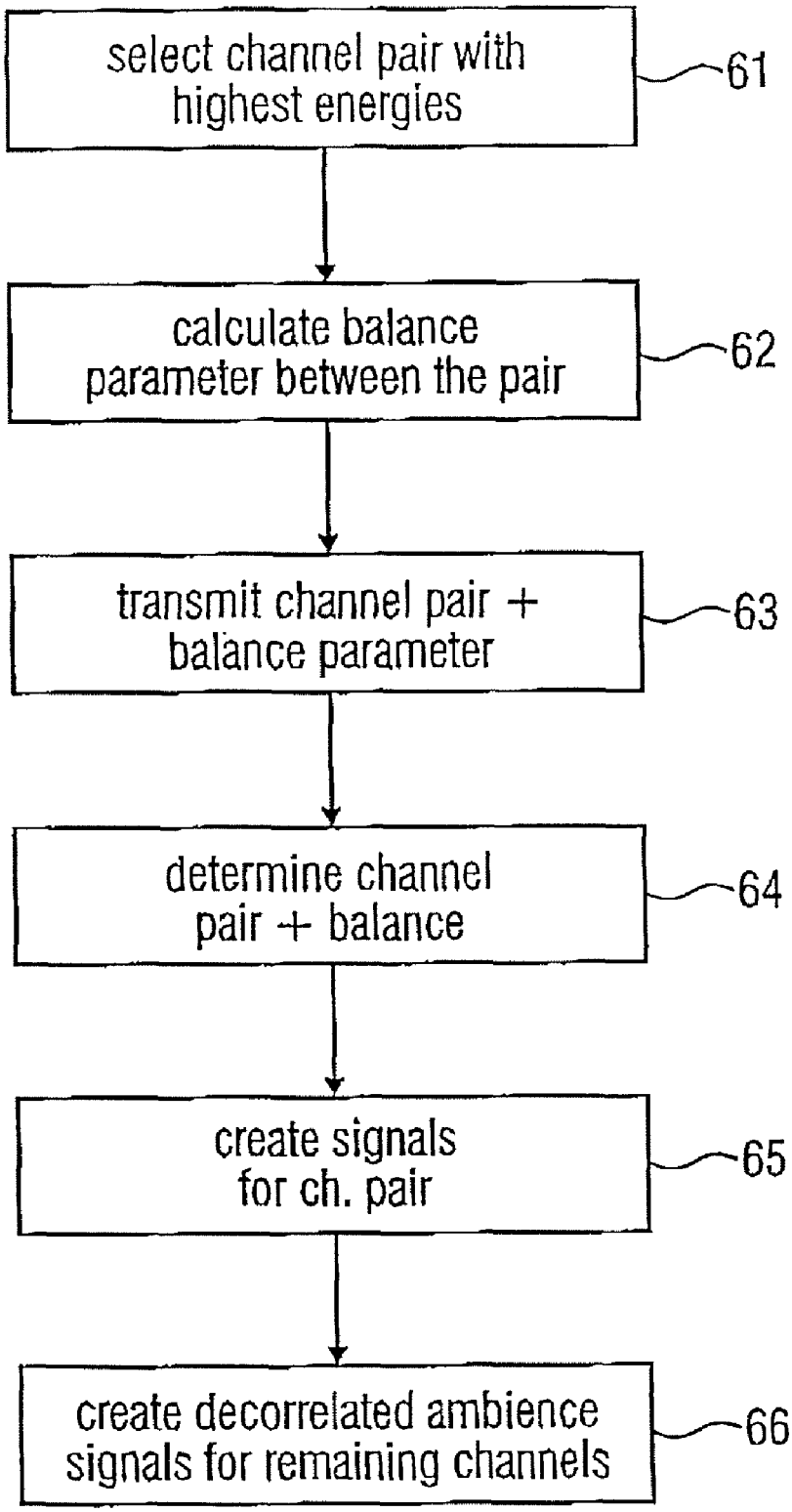
FIG. 6*a* shows a general flow chart of the route and pan embodiment.

FIG. 6*a* indicates a flow chart for the route and pan embodiment. In a step 61, the channel pair with the highest energies is selected. Then, a balance parameter between the pair is calculated (62). Then, the channel pair and the balance parameter are transmitted to a decoder as the direction parameter information (36). On the decoder-side, the transmitted direction parameter information is used for determining the channel pair and the balance between the channels (64). Based on the channel pair and the balance value, the signals for the direct channels are generated using, for example, a normal mono/stereo-up-mixer (PSP) (65). Additionally, decorrelated ambiences signals for remaining channels are created using one or more decorrelated ambience signals (DAP) (66).

Figure 6B:
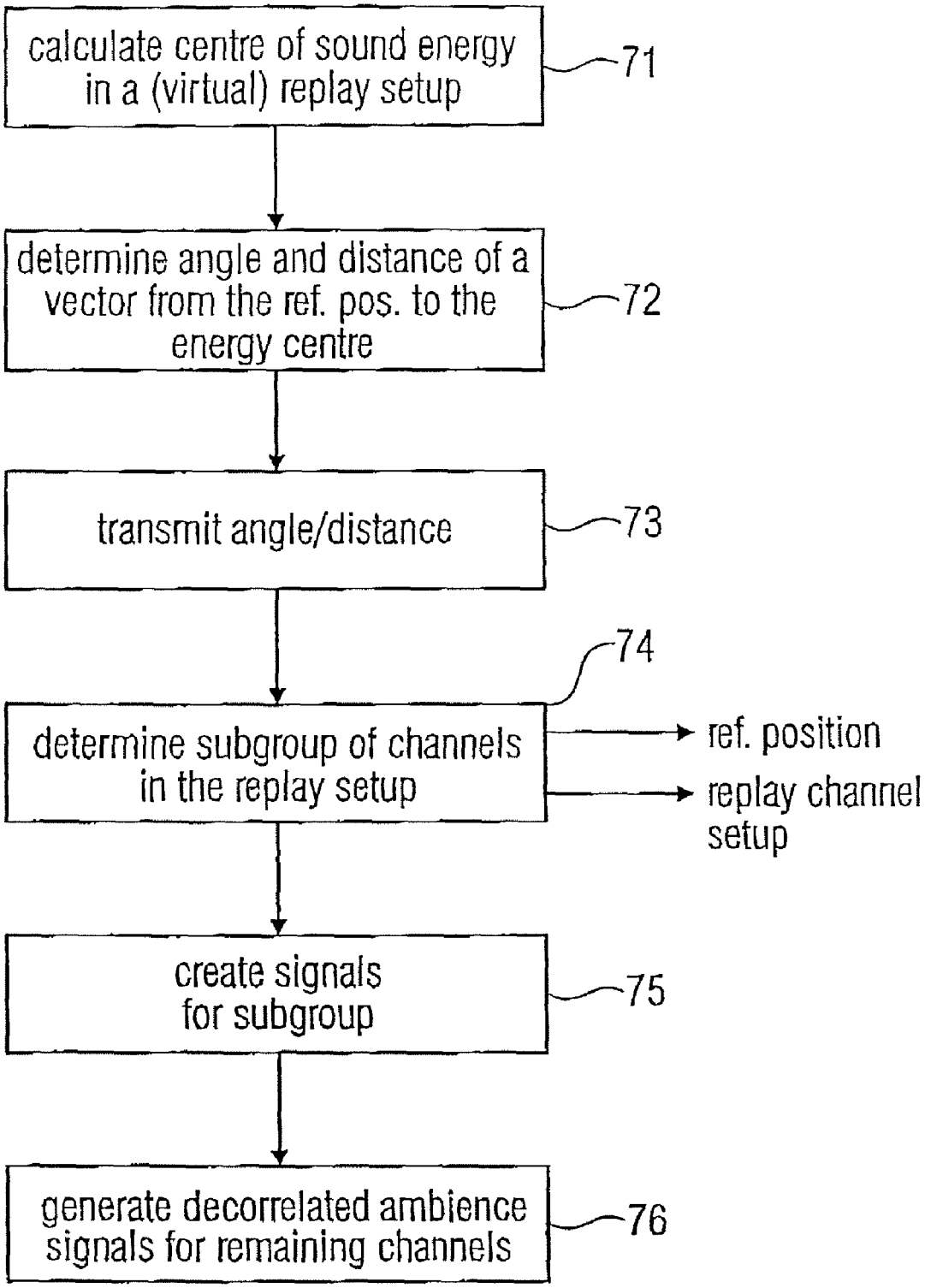
FIG. 6*b* shows a flow chart of the preferred angle and radius embodiment.

The angle and radius embodiment is illustrated as a flow diagram in FIG. 6*b*. In a step 71, a center of the sound energy in a (virtual) replay setup is calculated. Based on the center of a sound and a reference position, an angle and a distance of a vector from the reference position to the energy center are determined (72).

Then, the angle and distance are transmitted as the direction parameter information (angle) and a spreading measure (distance) as indicated in step 73. The spreading measure indicates how many speakers are active for generating the direct signal. Stated in other words, the spreading measure indicates a place of a region, in which the energy is concentrated, which is not positioned on a connecting line between two speakers (such a position is fully defined by a balance parameter between these speakers) but which is not positioned on such a connecting line. For reconstructing such a position, more than two speakers are required.

In a preferred embodiment, the spreading parameter can also be used as a kind of a coherence parameter to synthetically increase the width of the sound compared to a case, in which all direct speakers are emitting fully correlated signals. In this case, the length of the vector can also be used to control a reverberator or any other device generating a de-correlated signal to be added to a signal for a "direct" channel.

On the decoder-side, a sub-group of channels in the replay setup is determined using the angle, the distance, the reference position and the replay channel setup as indicated at step 74 in FIG. 6*b*. In step 75, the signals for the sub-group are generated using a one to n up-mix controlled by the angle, the radius, and, therefore, by the number of channels included in a sub-group. When the number of channels in the sub-group is small and, for example, equal to two, which is the case, when the radius has a large value, a simple up-mix using a balance parameter indicated by the angle of the vector can be used as in the FIG. 6*a* embodiment. When, however, the radius decreases and, therefore, the number of channels within the sub-group increases, it is possible to use a look-up table on the decoder-side which has, as an input, angle and radius, and which has, as an output, an identification for each channel in a sub-group associated with the certain vector and a level parameter, which is, preferably, a percentage parameter which is applied to the mono signal energy to determine the signal energy in each of the output channels within the selected sub-group. As stated in step 76 of FIG. 6*b*, decorrelated ambience signals are generated and forwarded to the non-selected speakers.

Depending on certain implementation requirements of the inventive methods, the inventive methods can be implemented in hardware or in software. The implementation can be performed using a digital storage medium, in particular a disk or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for reconstructing a multi-channel signal using at least one base channel and a parametric representation comprising direction parameter information indicating a direction from a reference position in a replay setup to a region in the replay setup, in which a combined sound energy of at least three original channels is concentrated, from which the at least one base channel has been derived, and comprising a balance parameter, the apparatus comprising:

an output channel generator for generating a number of output channels to be positioned in the replay setup with respect to the reference position, the number of output channels being higher than the number of base channels, wherein the output channel generator is configured to generate the output channels in response to the direction parameter information so that the direction from the reference position to the region, in which the combined energy of the reconstructed output channels is concentrated depends on the direction indicated by the direction parameter information, wherein the output channel generator is configured to select a pair of output channels using the direction parameter to obtain a selected pair of output channels, the direction parameter comprising information on a pair of output channels as a direction from a reference position in a replay setup to a region in the replay setup, in which a combined sound energy of at least three original channels is concentrated, wherein the output channel generator is configured to calculate audio signals for the selected pair of output channels using the balance parameter indicating a balance between the selected pair of output channels such that an energy distribution between the selected pair of output channels is determined by the balance parameter, and wherein the output channel generator is configured to calculate one or more ambience channel signals for one or more channels not included in the selected pair of output channels, wherein the output channel generator comprises a hardware implementation.

2. The apparatus in accordance with claim 1, in which the output channel generator is operative to calculate at least two output channels based on the direction parameter information and to use a signal derived from the base channel, the signal being different from the base channel in terms of delay, gain, correlation or equalization, for remaining output channels in order to generate an ambience signal.

3. The apparatus in accordance with claim 2, in which the output channel generator is operative to calculate the remaining channels so that an energy thereof is in accordance with a predefined setting or such that a combined energy of the remaining channels depends on an ambience parameter additionally included in the parametric representation.

4. The apparatus in accordance with claim 1, in which the direction parameter information include an angle related to the reference position in the replay setup, the angle defining a vector originating from a reference position in the replay setup, and in which the output channel generator is operative to map the angle to a sub-group of all channels in the replay setup and to determine an energy distribution between the channels in the sub-group based on the angle.

5. The apparatus in accordance with claim 4, in which the direction parameter information further includes an information on a length of a vector, in which the output channel generator is operative to map the angle such that a number of channels in the sub-group depends on the length of the vector.

6. The apparatus in accordance with claim 4, in which the output channel generator is operative to map the angle using a mapping rule which depends on the replay setup to be connected to the apparatus for reconstructing, and, wherein the mapping rule is such that energies of two adjacent channels, which define a sector, in which the vector is located, are higher than energies of channels outside the sector.

7. The apparatus in accordance with claim 1, in which the output channel generator includes a decorrelator for generating a decorrelated signal based on the at least one base channel, and in which the output channel generator is further operative to add the decorrelated signal to direct sound output channels based on a coherence parameter included in the parametric representation, or to include the decorrelated signal into ambience output channels, which have a distribution of energy, which is not controlled by the direction parameter information.

8. The apparatus in accordance with claim 1, in which the direction parameter information includes information on an identification of output channels which are not adjacent to each other in the replay setup, and in which the output channel generator is operative to conduct an at least three-channel panning for calculating an energy distribution between the two channels identified by the direction parameter information and an at least one channel between the identified channels based on the direction parameter information.

9. A method of reconstructing a multi-channel signal using at least one base channel and a parametric representation comprising direction parameter information indicating a direction from a reference position in a replay setup to a region in the replay setup, in which a combined sound energy of at least three original channels is concentrated, from which the at least one base channel has been derived, and comprising a balance parameter, the method comprising:

generating, by an output channel generator, a number of output channels to be positioned in the replay setup with respect to the reference position, the number of output channels being higher than the number of base channels, wherein the step of generating is performed such that the output channels are generated in response to the direction parameter information so that the direction from the reference position to the region, in which the combined energy of the reconstructed output channels is concentrated depends on the direction indicated by the direction parameter information, wherein the step of generating comprises selecting a pair of output channels using the direction parameter to obtain a selected pair of output channels, the direction parameter comprising information on a pair of channels as a direction from a reference position in a replay setup to a region in the replay setup, in which a combined sound energy of at least three original channels is concentrated, calculating audio signals for the selected pair of output channels using the balance parameter indicating a balance between the selected pair of output channels such that an energy distribution between the selected pair of output channels is determined by the balance parameter, and calculating one or more ambience channel signals for one or more channels not included in the selected pair of output channels, wherein the output channel generator comprises a hardware implementation.

10. A non-transitory storage medium having stored thereon a computer program having machine-readable instructions for performing, when running on a computer, a method of reconstructing a multi-channel signal using at least one base channel and a parametric representation comprising direction parameter information indicating a direction from a reference position in a replay setup to a region in the replay setup, in which a combined sound energy of at least three original channels is concentrated, from which the at least one base channel has been derived, and comprising a balance parameter, the method comprising:

generating a number of output channels to be positioned in the replay setup with respect to the reference position, the number of output channels being higher than the number of base channels, wherein the generating is performed such that the output channels are generated in response to the direction parameter information so that the direction from the reference position to the region, in which the combined energy of the reconstructed output channels is concentrated depends on the direction indicated by the direction parameter information, wherein the generating comprises selecting a pair of output channels using the direction parameter to obtain a selected pair of output channels, the direction parameter comprising information on a pair of channels as a direction from a reference position in a replay setup to a region in the replay setup, in which a combined sound energy of at least three original channels is concentrated, calculating audio signals for the selected pair of output channels using the balance parameter indicating a balance between the selected pair of output channels such that an energy distribution between the selected pair of output channels is determined by the balance parameter, and calculating one or more ambience channel signals for one or more channels not included in the selected pair of output channels.

* * * * *